US012454400B1

(12) United States Patent
Stiglic et al.

(10) Patent No.: US 12,454,400 B1
(45) Date of Patent: Oct. 28, 2025

(54) THERMOPLASTIC BAGS WITH LIQUID ABSORPTION CAPABILITIES

(71) Applicant: THE GLAD PRODUCTS COMPANY, Oakland, CA (US)

(72) Inventors: Jeffrey S. Stiglic, Willowbrook, IL (US); Elizabeth Anne Wilder, West Chester, OH (US); Sean Chang, Cincinnati, OH (US); Henry Rose, Cincinnati, OH (US); David A. Bailey, Cincinnati, OH (US)

(73) Assignee: THE GLAD PRODUCTS COMPANY, Oakland, CA (US)

( * ) Notice: Subject to any disclaimer, the term of this patent is extended or adjusted under 35 U.S.C. 154(b) by 0 days.

(21) Appl. No.: 18/647,284

(22) Filed: Apr. 26, 2024

(51) Int. Cl.
*B65D 81/26* (2006.01)
*B65D 33/00* (2006.01)

(52) U.S. Cl.
CPC ..... *B65D 81/264* (2013.01); *B65D 33/00* (2013.01)

(58) Field of Classification Search
CPC ..... B65D 81/264; B65D 33/00
USPC ..... 206/204, 223, 524.4, 524.3; 383/116
See application file for complete search history.

(56) References Cited

U.S. PATENT DOCUMENTS 2,980,313 A * 4/1961 Quinn ..... B65D 81/26 383/17
5,323,906 A * 6/1994 Gouge ..... A01N 39/04 424/409
5,404,999 A 4/1995 Bednar
5,451,437 A * 9/1995 Insley ..... B65D 81/264 428/36.1
6,245,693 B1 6/2001 Gagliardi et al.
6,642,428 B1 11/2003 Kurata et al.
8,764,990 B1 7/2014 Julian et al.
2002/0141898 A1 10/2002 Carlucci et al.
2003/0060112 A1 3/2003 Rezai et al.
2015/0203291 A1 7/2015 Saville et al.
2019/0335746 A1 11/2019 Freedman et al.
2023/0088606 A1* 3/2023 O'Shea ..... B65D 81/268 206/204

FOREIGN PATENT DOCUMENTS

WO 2006135562 A2 12/2006

OTHER PUBLICATIONS

International Search Report and Written Opinion as received in PCT/US2025/024989 dated Jun. 23, 2025.

* cited by examiner

*Primary Examiner* — Jacob K Ackun
(74) *Attorney, Agent, or Firm* — Keller Preece, PLLC

(57) ABSTRACT

The present disclosure relates to thermoplastic bags with liquid absorption capabilities. In particular, in one or more embodiments, the disclosed thermoplastic bags include a first sidewall and a second sidewall joined together along a first side edge, a second side edge, and a bottom edge, while having an opening opposite the bottom edge. Furthermore, in some embodiments, the disclosed thermoplastic bags have an absorbent adhesive material disposed on at least one of the first sidewall and the second sidewall. In some embodiments, the absorbent adhesive material is configured to absorb twenty to fifty milliliters of liquid while maintaining a viscosity above fifteen thousand centipoises.

20 Claims, 11 Drawing Sheets

THERMOPLASTIC BAGS WITH LIQUID ABSORPTION CAPABILITIES

BACKGROUND

Among their many applications, thermoplastic bags are used as liners in trash or refuse receptacles. Such liners can be found at many locations from small household kitchen garbage cans to larger, multi-gallon drums located in public places and restaurants. Bags that are intended to be used as liners for such refuse containers are typically made from low-cost, pliable thermoplastic material. When the receptacle is full, the thermoplastic liner holding the trash may be removed for disposal and replaced with a new liner. A common problem with thermoplastic bags is leakage of liquid refuse through a puncture or tear in the bag. For instance, when liquids are discarded (e.g., partially consumed beverages, etc.) into a trash bag, the liquids can flow toward a bottom of the bag. Moreover, the trash bag can sustain tears, rips, punctures, or other failures due to heavy weight of the trash and/or sharp objects in the trash, among other causes. Consequently, the liquids can flow through the tears, rips, or punctures and out of the bag, thereby causing leaks into the trash receptacle and/or onto floors or the ground when transporting the bag to a dumpster. Thus, there is a need for thermoplastic bags with liquid absorbing capabilities to mitigate the problem of leaks out of trash bags.

BRIEF SUMMARY

Embodiments of the present disclosure provide benefits and/or solve one or more of the foregoing or other problems in the art with thermoplastic bags that include absorbent adhesive materials to absorb and stop the flow of liquids in the bags. For example, in some embodiments, the disclosed thermoplastic bags include a superabsorbent polymer that can absorb liquids. In some implementations, the superabsorbent polymer can mix with the liquid to form a gel or paste that has a high viscosity, thereby inhibiting flow of the liquid. To illustrate, in some embodiments, the superabsorbent polymer is applied to a bottom portion of a thermoplastic bag such that, when the superabsorbent polymer comes into contact with liquid in the bag, the resulting gel has a viscosity that prevents the gel from easily exiting the bag through rips or holes.

Moreover, in some embodiments, the disclosed thermoplastic bags include a superabsorbent polymer that has absorbent properties sufficient to prevent leaks from thermoplastic bags at quantities low enough to be manufacturable. For example, in some implementations, the disclosed thermoplastic bags include a low amount of superabsorbent polymer that has high absorbency. For instance, in some embodiments, the disclosed thermoplastic bags have a small amount of superabsorbent polymer (e.g., measured as a percentage of tap water) that yields a high viscosity when mixed with the water, thereby preventing (or limiting) leaks from the thermoplastic bag.

The following description sets forth additional features and advantages of one or more embodiments of the disclosed thermoplastic bags. In some cases, such features and advantages are evident to a skilled artisan having the benefit of this disclosure, or may be learned by the practice of the disclosed embodiments.

BRIEF DESCRIPTION OF THE DRAWINGS

The detailed description provides one or more embodiments with additional specificity and detail through the use of the accompanying drawings, as briefly described below.

DETAILED DESCRIPTION

Figure 1C:
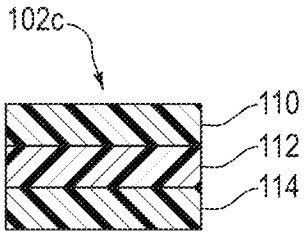
FIGS. 1A-1C illustrate partial side cross-sectional views of films having varying numbers of layers that can be included in a thermoplastic bag in accordance with one or more embodiments.

This disclosure describes one or more embodiments of thermoplastic bags that include absorbent adhesive materials to absorb and stop the flow of liquids within the bags. For example, in some embodiments, the thermoplastic bags include a superabsorbent polymer that can absorb liquids (e.g., discarded beverages, etc.). In some implementations, the superabsorbent polymer can mix with the liquid to form a gel or paste that has a high viscosity, thereby inhibiting flow of the liquid. To illustrate, in some embodiments, the superabsorbent polymer is applied to a bottom portion of a thermoplastic bag such that, when the superabsorbent polymer comes into contact with liquid in the bag, the resulting gel has a viscosity that prevents, or reduces the ease at which the gel is able to move and exit the bag through holes or rips.

To illustrate, in some embodiments when a liquid mixes with the superabsorbent polymer it forms a hydrogel. In some embodiments, the hydrogel has a high viscosity relative to the liquid before mixture with the superabsorbent polymer. For instance, in some implementations, the superabsorbent polymer can mix with 20-50 milliliters of water (or similar liquid) and produce the hydrogel having a viscosity above 15000 centipoises. Moreover, in some implementations, the superabsorbent polymer can mix with 25-50 milliliters of water (or similar liquid) and produce the hydrogel having a viscosity above 15000 centipoises. Furthermore, in some implementations, the superabsorbent polymer can mix with 25-50 milliliters of water (or similar liquid) and produce the hydrogel having a viscosity above 50000 centipoises. In some implementations, the superabsorbent polymer can mix with 25-50 milliliters of water (or similar liquid) and produce the hydrogel having a viscosity above 85000 centipoises.

In addition, the superabsorbent polymer can prevent (or reduce) the incidence of leaks out of a thermoplastic bag. For example, by absorbing the liquid and forming a hydrogel, the superabsorbent polymer can prevent (or reduce) further flow of the liquid. In particular, the superabsorbent polymer can prevent (or limit) leaks of the liquid though holes (e.g., rips, tears, punctures, etc.) in the thermoplastic bag. For instance, in some implementations, the superabsorbent polymer is configured to prevent the liquid from egressing out of the thermoplastic bag through holes in the thermoplastic bag.

As an initial matter, the thermoplastic material of the films of one or more implementations of the present disclosure may include thermoplastic polyolefins, including polyethylene and copolymers thereof and polypropylene and copolymers thereof. The olefin-based polymers may include ethylene or propylene-based polymers such as polyethylene, polypropylene, and copolymers such as ethylene vinyl acetate (EVA), ethylene methyl acrylate (EMA) and ethylene acrylic acid (EAA), or blends of such polyolefins.

Other examples of polymers suitable for use as films in accordance with the present disclosure may include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), oriented poly(ethylene-terephthalate), poly (ethylene-butylacrylate), polyurethane, poly(ethylene-propylene-diene), ethylene-propylene rubber, nylon, etc.

Some of the examples and description herein refer to films formed from linear low-density polyethylene. The term "linear low-density polyethylene" (LLDPE) as used herein is defined to mean a copolymer of ethylene and a minor amount of an olefin containing 4 to 10 carbon atoms, having a density of from about 0.910 to about 0.930, and a melt index (MI) of from about 0.5 to about 10. For example, some examples herein use an octene comonomer, solution phase LLDPE (MI=1.1; $\rho$=0.920). Additionally, other examples use a gas phase LLDPE, which is a hexene gas phase LLDPE formulated with slip/AB (MI=1.0; $\rho$=0.920). Still further examples use a gas phase LLDPE, which is a hexene gas phase LLDPE formulated with slip/AB (MI=1.0; $\rho$=0.926). One will appreciate that the present disclosure is not limited to LLDPE and can include "high density polyethylene" (HDPE), "low density polyethylene" (LDPE), and "very low density polyethylene" (VLDPE). Indeed, films made from any of the previously mentioned thermoplastic materials or combinations thereof can be suitable for use with the present disclosure.

Some implementations of the present disclosure may include any flexible or pliable thermoplastic material that may be formed or drawn into a web or film. Furthermore, the thermoplastic materials may include a single layer or multiple layers. The thermoplastic material may be opaque, transparent, translucent, or tinted. Furthermore, the thermoplastic material may be gas permeable or impermeable.

As used herein, the term "flexible" refers to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and bags that are flexible, therefore, may be altered in shape and structure to accommodate external forces and to conform to the shape of objects brought into contact with them without losing their integrity. In accordance with further prior art materials, web materials are provided which exhibit an "elastic-like" behavior in the direction of applied strain without the use of added traditional elastic materials. As used herein, the term "elastic-like" describes the behavior of web materials which when subjected to an applied strain, the web materials extend in the direction of applied strain, and when the applied strain is released the web materials return, to a degree, to their pre-strained condition.

As used herein, the term "substantially," in reference to a given parameter, property, or condition, means to a degree that one of ordinary skill in the art would understand that the given parameter, property, or condition is met within a degree of variance, such as within acceptable manufacturing tolerances. By way of example, depending on the particular parameter, property, or condition that is substantially met, the parameter, property, or condition may be at least 70.0% met, at least 80.0%, at least 90% met, at least 95.0% met, at least 99.0% met, at least 99.9% met, or even 100% met.

Additional additives that may be included in one or more implementations include slip agents, anti-block agents, voiding agents, or tackifiers. Additionally, one or more implementations of the present disclosure include films that are devoid of voiding agents. Some examples of inorganic voiding agents, which may further provide odor control, include the following but are not limited to calcium carbonate, magnesium carbonate, barium carbonate, calcium sulfate, magnesium sulfate, barium sulfate, calcium oxide, magnesium oxide, titanium oxide, zinc oxide, aluminum hydroxide, magnesium hydroxide, talc, clay, silica, alumina, mica, glass powder, starch, charcoal, zeolites, any combination thereof, etc. Organic voiding agents, polymers that are immiscible in the major polymer matrix, can also be used. For instance, polystyrene can be used as a voiding agent in polyethylene and polypropylene films.

One of ordinary skill in the art will appreciate in view of the present disclosure that manufacturers may form the films or webs to be used with the present disclosure using a wide variety of techniques. For example, a manufacturer can form precursor mix of the thermoplastic material and one or more additives. The manufacturer can then form the film(s) from the precursor mix using conventional flat or cast extrusion or co-extrusion to produce monolayer, bilayer, or multilayer films. Alternatively, a manufacturer can form the films using suitable processes, such as, a blown film process to produce monolayer, bilayer, or multilayer films. If desired for a given end use, the manufacturer can orient the films by trapped bubble, tenterframe, or other suitable process. Additionally, the manufacturer can optionally anneal the films thereafter.

An optional part of the film-making process is a procedure known as "orientation." The orientation of a polymer is a reference to its molecular organization, i.e., the orientation of molecules relative to each other. Similarly, the process of orientation is the process by which directionality (orientation) is imposed upon the polymeric arrangements in the film. The process of orientation is employed to impart desirable properties to films, including making cast films tougher (higher tensile properties). Depending on whether the film is made by casting as a flat film or by blowing as a tubular film, the orientation process can require different procedures. This is related to the different physical characteristics possessed by films made by conventional film-making processes (e.g., casting and blowing). Generally, blown films tend to have greater stiffness and toughness. By contrast, cast films usually have the advantages of greater film clarity and uniformity of thickness and flatness, generally permitting use of a wider range of polymers and producing a higher quality film.

When a film has been stretched in a single direction (mono-axial orientation), the resulting film can exhibit strength and stiffness along the direction of stretch, but can be weak in the other direction, i.e., across the stretch, often splitting when flexed or pulled. To overcome this limitation, two-way or biaxial orientation can be employed to more evenly distribute the strength qualities of the film in two directions. Most biaxial orientation processes use apparatus that stretches the film sequentially, first in one direction and then in the other.

In one or more implementations, the films of the present disclosure are blown film, or cast film. Both a blown film and a cast film can be formed by extrusion. The extruder used can be a conventional one using a die, which will provide the desired gauge. Some useful extruders are described in U.S. Pat. Nos. 4,814,135; 4,857,600; 5,076,988; 5,153,382; each of which are incorporated herein by reference in their entirety. Examples of various extruders, which can be used in producing the films to be used with the present disclosure, can be a single screw type modified with a blown film die, an air ring, and continuous take off equipment.

In one or more implementations, a manufacturer can use multiple extruders to supply different melt streams, which a feed block can order into different channels of a multi-channel die. The multiple extruders can allow a manufacturer to form a film with layers having different compositions. Such multi-film bag may later be provided with a complex stretch pattern to provide the benefits of the present disclosure.

In a blown film process, the die can be an upright cylinder with a circular opening. Rollers can pull molten thermoplastic material upward away from the die. An air-ring can cool the film as the film travels upwards. An air outlet can force compressed air into the center of the extruded circular profile, creating a bubble. The air can expand the extruded circular cross section by a multiple of the die diameter. This ratio is called the "blow-up ratio." When using a blown film process, the manufacturer can collapse the film to double the plies of the film. Alternatively, the manufacturer can cut and fold the film, or cut and leave the film unfolded.

In any event, in one or more implementations, the extrusion process can orient the polymer chains of the blown film. The "orientation" of a polymer is a reference to its molecular organization, i.e., the orientation of molecules or polymer chains relative to each other. In particular, the extrusion process can cause the polymer chains of the blown film to be predominantly oriented in the machine direction. The orientation of the polymer chains can result in an increased strength in the direction of the orientation. As used herein predominately oriented in a particular direction means that the polymer chains are more oriented in the particular direction than another direction. One will appreciate, however, that a film that is predominately oriented in a particular direction can still include polymer chains oriented in directions other than the particular direction. Thus, in one or more implementations the initial or starting films (films before being stretched or bonded or laminated in accordance with the principles described herein) can comprise a blown film that is predominately oriented in the machine direction.

The process of blowing up the tubular stock or bubble can further orient the polymer chains of the blown film. In particular, the blow-up process can cause the polymer chains of the blown film to be bi-axially oriented. Despite being bi-axially oriented, in one or more implementations the polymer chains of the blown film are predominantly oriented in the machine direction (i.e., oriented more in the machine direction than the transverse direction).

The films of one or more implementations of the present disclosure can have a starting gauge between about 0.1 mils to about 20 mils, suitably from about 0.2 mils to about 4 mils, suitably in the range of about 0.3 mils to about 2 mils, suitably from about 0.6 mils to about 1.25 mils, suitably from about 0.9 mils to about 1.1 mils, suitably from about 0.3 mils to about 0.7 mils, and suitably from about 0.4 mils and about 0.6 mils. Additionally, the starting gauge of films of one or more implementations of the present disclosure may not be uniform. Thus, the starting gauge of films of one or more implementations of the present disclosure may vary along the length and/or width of the film.

As described above, a multi-film thermoplastic bag includes a plurality of thermoplastic films. Each individual film may itself include a single layer or multiple layers. In other words, the individual films of the multi-film bag may each themselves comprise a plurality of layers. Such layers may be significantly more tightly bonded together than the bonding (if any) of the contact areas. Both tight and relatively weak bonding can be accomplished by joining layers by mechanical pressure, joining layers with heat, joining with heat and pressure, joining layers with adhesives, spread coating, extrusion coating, ultrasonic bonding, static bonding, cohesive bonding, and combinations thereof. Adjacent sub-layers of an individual film may be coextruded. Co-extrusion results in tight bonding so that the bond strength is greater than the tear resistance of the resulting laminate (i.e., rather than allowing adjacent layers to be peeled apart through breakage of the lamination bonds, the film will tear).

As used herein, the term "absorbent adhesive material" refers to a material that can adhere to a thermoplastic film and absorb liquid. In particular, the term "absorbent adhesive material" can include a superabsorbent polymer mixed with a binding agent or adhesive matrix. A superabsorbent polymer is capable of absorbing and retaining many times its own weight in fluids (e.g., water). Superabsorbent polymers and copolymers include, but are not limited to, partially neutralized hydrogel-forming gelling materials, such as polyacrylate gelling material and acrylate grafted starch gelling material, for example, potassium acrylate, sodium acrylate, potassium polyacrylate, sodium polyacrylate, solution polymers, and superabsorbent fibers. Sodium polyacrylate, for example, is a hydrophilic polymer material that can hold up to 20 times its weight in water and, in some instances, up to 1000 times its weight in water. Superabsorbent polymers are typically available as particulates or flake-like crystals that can be easily intermixed with and suspended in an adhesive matrix. In other implementations, instead of or in addition to the superabsorbent polymer, the absorbent adhesive material can include, but is not limited to, clay, silica, talc, diatomaceous earth, perlite, vermiculite, carbon, kaolin, mica, barium sulfate, aluminum silicates, sodium carbonates, calcium carbonates, absorbent gelling materials, creped tissue, foams, wood pulp, cotton, cotton batting, paper, cellulose wadding, sponges, and desiccants.

The adhesive matrix can be any combination of non-aqueous solvent and suitable binding agent or film former that demonstrates adhesion to the thermoplastic film. The mixture of superabsorbent polymer and adhesive matrix can form a slurry that can be applied to the inner surfaces of the sidewalls of thermoplastic films. The combination of the superabsorbent polymer and adhesive matrix can have elastic properties to accommodate the flexibility of the thermoplastic film as well as any swelling of the superabsorbent polymer that may occur during liquid absorption. Examples of suitable types of adhesives include common binding agents such as cellulose, silicone, and acrylic-based resins. In some cases, other adhesives such as hot-melt, natural or synthetic waterborne, solventborne, extrudable, and/or pressure sensitive adhesives, or multi-component glues are used.

Figure 1B:
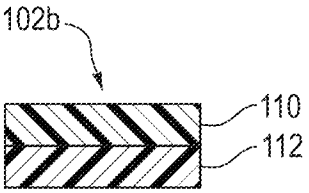
Figure 1A:
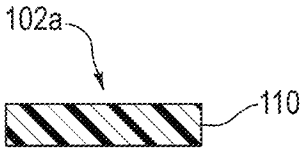

A thermoplastic film can include one, two, three, or more layers of thermoplastic material. FIGS. 1A-1C are partial cross-sectional views of films that can be included in a thermoplastic bag of one or more implementations. In some implementations, the film may include a single layer film 102*a*, as shown in FIG. 1A, comprising a single first layer 110. In other embodiments, the film can comprise a two-layer film 102*b* as shown in FIG. 1B, including the first layer 110 and a second layer 112. The first and second layers 110, 112 can be coextruded. In such implementations, the first and second layers 110, 112 may optionally include different grades of thermoplastic material and/or include different additives, including polymer additives and/or pigments. In yet other implementations, a film may be a tri-layer film 102*c*, as shown in FIG. 1C, including the first layer 110, the second layer 112, and a third layer 114. In yet other implementations, a film may include more than three layers. The tri-layer film 102*c* can include an A:B:C configuration in which all three layers vary in one or more of gauge, composition, color, transparency, or other properties. Alternatively, the tri-layer film 102*c* can comprise an A:A:B structure or A:B:A structure in which two layers have the same composition, color, transparency, or other properties. In an A:A:B structure or A:B:A structure the A layers can comprise the same gauge or differing gauge. For example, in an A:A:B structure or A:B:A structure the film layers can comprise layer ratios of 20:20:60, 40:40:20, 15:70:15, 33:34:33, 20:60:20, 40:20:40, or other ratios.

In one example, the film 102*a* can comprise a 0.5 mil, 0.920 density LLDPE, colored film containing 4.8% pigment that appears a first color. In an alternative embodiment, the film 102*a* can comprise a 0.5 mil, 0.920 density LLDPE, un-pigmented film that appears clear or substantially clear. In still further embodiments, the film 102*a* can comprise a 0.5 mil, 0.920 density LLDPE, pigmented film that appears a second color.

In at least one implementation, such as shown in FIG. 1C, a multilayered film 102*c* can include coextruded layers. For example, the film 102*c* can include a three-layer B:A:B structure, where the ratio of layers can be 20:60:20. The exterior B layers (i.e., the first layer 110, and the third layer 114) can comprise a mixture of hexene LLDPE of density 0.918 and metallocene LLDPE of density 0.920. The interior A core layer (i.e., the second layer 112) can comprise a mixture of hexene LLDPE of density 0.918, butene LLDPE of density 0.918, and reclaimed resin from trash bags. Additionally, the A core layer (i.e., the second layer 112) can include a pigment. For example, the A core layer can include a colorant in an amount between about 0.1 percent and about 6 percent.

In another example, the film 102*c* is a coextruded three-layer B:A:B structure where the ratio of layers is 15:70:15. The B:A:B structure can also optionally have a ratio of B:A that is greater than 20:60 or less than 15:70. In one or more implementations, the LLDPE can comprise greater than 50% of the overall thermoplastic material in the film 102*c*.

In another example, the film 102*c* is a coextruded three-layer C:A:B structure where the ratio of layers is 20:60:20. The C layer (i.e., the first layer 110) can comprise a LLDPE material with a first colorant (e.g., black). The B layer (i.e., the third layer 114) can comprise a LLDPE material with a second colorant (e.g., white). The LLDPE material can have a MI of 1.0 and density of 0.920 g/cm$^3$. The A core layer (i.e., the second layer 112) can comprise similar materials to any of the core layers described above. The A core layer can comprise a black colorant, a white colorant, or can be clear.

In still further embodiments, a film can comprise any number of coextruded layers. More particularly, in one or more embodiments, a film can comprise any number of coextruded layers so long as the A and B layers do not alternate such that the A layers are on one side and the B layers are on the other side. In still further embodiments, a film can comprise one or more coextruded layers between the A and B layers. For example, the film can comprise clear or transparent layers between the A and B layer(s). In still further embodiments, a film can comprise intermittent layers of different colors in addition to the A and B layer(s).

Figure 2:
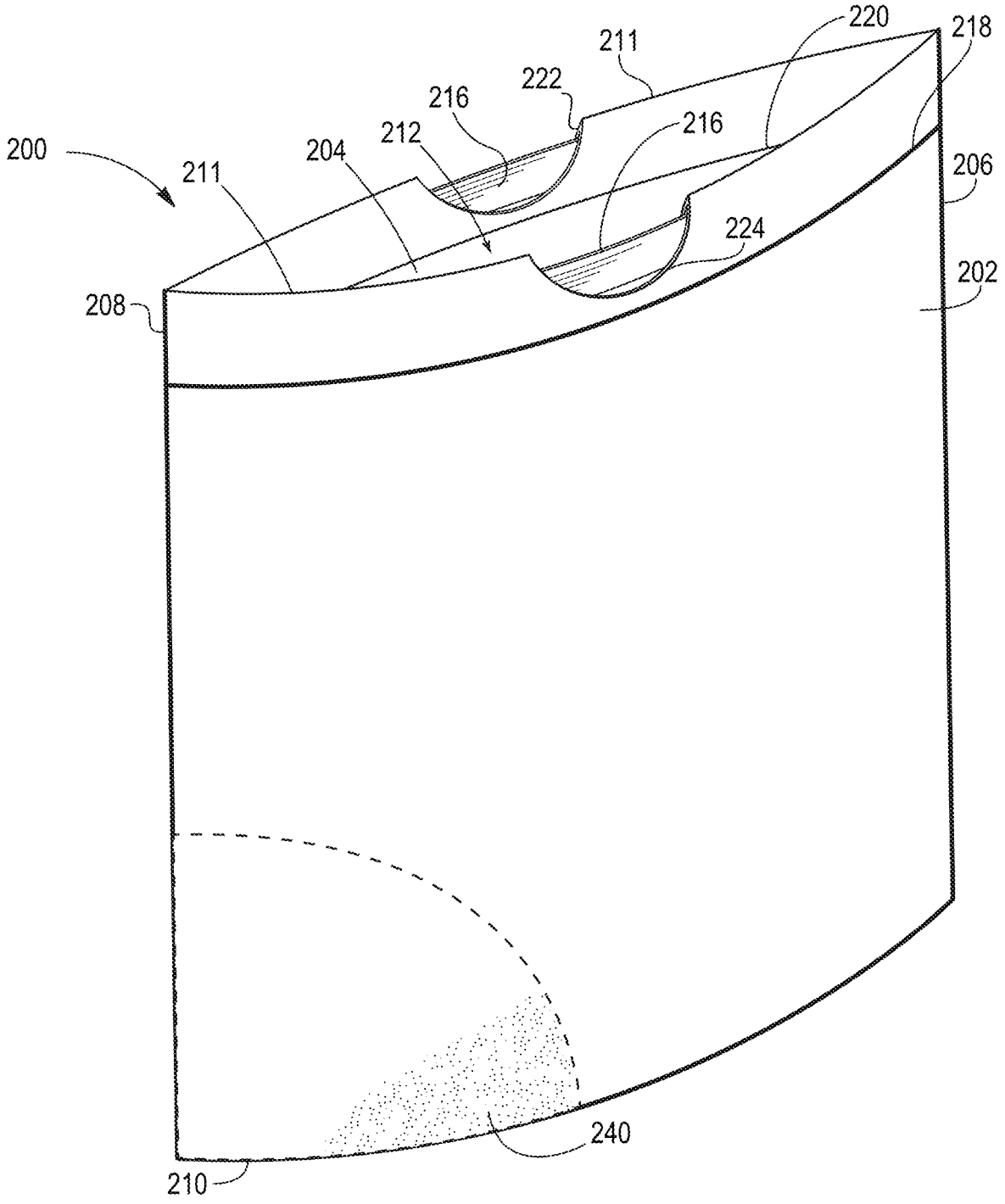
FIG. 2 illustrates a perspective view of a thermoplastic bag that includes an absorbent adhesive material in accordance with one or more embodiments.

FIG. 2 is a perspective view of a thermoplastic bag 200 including an absorbent adhesive material according to one or more embodiments. The thermoplastic bag 200 includes a first sidewall 202 and a second sidewall 204. Each of the first and second sidewalls 202, 204 includes a first side edge 206, a second opposite side edge 208, and a bottom edge 210 extending between the first and second side edges 206, 208. Each of the first and second sidewalls 202, 204 also includes a top edge 211 extending between the first and second side edges 206, 208 opposite the bottom edge 210. In some implementations, the first sidewall 202 and the second sidewall 204 are joined together along the first side edges 206, the second opposite side edges 208, and the bottom edges 210. The first and second sidewalls 202, 204 may be joined along the first and second side edges 206, 208 and bottom edges 210 by any suitable process such as, for example, a heated pressure seal. In alternative implementations, the first and second sidewalls 202, 204 may not be joined along the side edges. Rather, the first and second sidewalls 202, 204 may be a single uniform piece. In other words, the first and second sidewalls 202, 204 may form a sleeve or a balloon structure.

In some implementations, the bottom edge 210 or one or more of the side edges 206, 208 can comprise a fold. In other words, the first and second sidewalls 202, 204 may comprise a single unitary piece of material. The top edges 211 of the first and second sidewalls 202, 204 may define an opening 212 to an interior of the thermoplastic bag 200. In other words, the opening 212 may be oriented opposite the bottom edge 210 of the thermoplastic bag 200. Furthermore, when placed in a receptacle (e.g., a trash can), the top edges 211 of the first and second sidewalls 202, 204 may be folded over the rim of the receptacle.

In some implementations, the thermoplastic bag 200 may optionally include a closure mechanism located adjacent to the top edges 211 for sealing the top of the thermoplastic bag 200 to form an at least substantially enclosed or fully enclosed container or vessel. As shown in FIG. 2, in some implementations, the closure mechanism comprises a draw tape 216, a first hem seal 218, and a second hem seal 220. In particular, the first top edge 211 of the first sidewall 202 may be folded over into the interior volume of the thermoplastic bag 200 and may be attached or secured to an interior surface of the first sidewall 202 by first hem seal 218. Similarly, the second top edge 211 of the second sidewall 204 is folded over into the interior volume and may be attached to an interior surface of the second sidewall 204 by a second hem seal 220.

Furthermore, in some implementations, each of the first and second hem seals 218, 220 comprises a continuous contact area, such that the layers of the thermoplastic bag 200 secured together by the first and second hem seals 218, 220 are in intimate contact with one another to form the first and second hem seals 218, 220. In some implementations, for example, the first top edge 211 of the first sidewall 202 is folded over into the interior volume and attached or secured to the interior surface of the first sidewall 202 by simultaneous application of heat on an outside face of the first sidewall 202 and pressure between the outside face and an inside face (e.g., within the interior volume) of the first sidewall 202. Similarly, the second top edge 211 of the second sidewall 204 is folded over into the interior volume and attached or secured to the interior surface of the second sidewall 204 by simultaneous application of heat on an outside face of the second sidewall 204 and pressure between the outside face and an inside face (e.g., within the interior volume) of the second sidewall 204.

As illustrated, the draw tape 216 extends through hem channels created by the first and second hem seals 218, 220 along the first and second top edges 211. The hem channel created by the first hem seal 218 includes a first aperture 224 (e.g., notch) extending through the hem channel and exposing a portion of the draw tape 216. Similarly, the hem channel created by the second hem seal 220 includes a second aperture 222 extending through the hem channel and exposing another portion of the draw tape 216. During use, pulling the draw tape 216 through the first and second apertures 222, 224 will cause the top edges 211 to constrict. As a result, pulling the draw tape 216 through the first and second apertures 222, 224 will cause the opening 212 of the thermoplastic bag 200 to at least partially close or reduce in size. The draw tape closure mechanism may be used with any of the implementations of a thermoplastic bag described herein.

Although the thermoplastic bag 200 is described herein as including a draw tape closure mechanism, one of ordinary skill in the art will readily recognize that other closure mechanisms may be implemented into the thermoplastic bag 200. For example, in some implementations, the closure mechanism may include one or more of flaps, adhesive tapes, a tuck and fold closure, an interlocking closure, a slider closure, a zipper closure, or any other closure structures known to those skilled in the art for closing a bag.

As discussed, in some embodiments, the thermoplastic bag 200 has an absorbent adhesive material on one or more of the first and second sidewalls 202, 204. For example, the thermoplastic bag 200 includes an absorbent adhesive material 240 disposed on an internal surface of the thermoplastic bag 200. To illustrate, in some embodiments, the thermoplastic bag 200 has the absorbent adhesive material 240 disposed on an internal surface of the first sidewall 202. In some embodiments, the thermoplastic bag 200 has the absorbent adhesive material 240 disposed on an internal surface of the second sidewall 204. In some embodiments, the thermoplastic bag 200 has absorbent adhesive material 240 disposed on both the internal surface of the first sidewall 202 and the internal surface of the second sidewall 204.

Moreover, in some embodiments, the absorbent adhesive material 240 is disposed near the bottom edge 210. For instance, the absorbent adhesive material 240 is disposed in a cluster or region within a bottom half of the thermoplastic bag 200. Furthermore, the absorbent adhesive material 240 can be disposed within a bottom third, a bottom quarter, a bottom fifth, or a bottom sixth of the thermoplastic bag 200. For example, in some embodiments, the absorbent adhesive material 240 is disposed within ten inches from the bottom edge 210, within eight inches from the bottom edge 210, within six inches from the bottom edge 210, within four inches from the bottom edge 210, or within two inches from the bottom edge 210.

Additionally, in some embodiments, the absorbent adhesive material 240 is disposed in a center portion of the thermoplastic bag 200. For instance, the absorbent adhesive material 240 is disposed in a cluster or region away from the first side edge 206 and the second side edge 208. For example, in some embodiments, the absorbent adhesive material 240 is disposed around a vertical centerline of the thermoplastic bag 200, within 90% of a total width of the thermoplastic bag 200. To illustrate, for a thermoplastic bag with a width of twenty-four inches, the region of the absorbent adhesive material 240 can be limited to a width of twenty-one and three-fifths inches, centered on the vertical centerline. In some embodiments, the absorbent adhesive material 240 is disposed within 80% of the total width of the thermoplastic bag 200 around the centerline. In some embodiments, the absorbent adhesive material 240 is disposed within 70% of the total width of the thermoplastic bag 200 around the centerline. In some embodiments, the absorbent adhesive material 240 is disposed within 60% of the total width of the thermoplastic bag 200 around the centerline. In some embodiments, the absorbent adhesive material 240 is disposed within 50% of the total width of the thermoplastic bag 200 around the centerline. In some embodiments, the absorbent adhesive material 240 is disposed within 95% of the total width of the thermoplastic bag 200 around the centerline.

As mentioned, in some implementations, the absorbent adhesive material is configured to absorb liquid within the thermoplastic bag 200. For instance, the absorbent adhesive material (e.g., the absorbent adhesive material 240) is a hydrophilic material that can retain a large amount of liquid (e.g., water, milk, juice, soft drink, coffee, etc.). In some embodiments, the absorbent adhesive material absorbs a liquid with a low viscosity (e.g., water) and, when mixed with the liquid, becomes a hydrogel with a high viscosity. For example, water at room temperature has a viscosity of approximately one centipoise. When mixed with water, the absorbent adhesive material can maintain a viscosity of several thousands of centipoises. For example, a superabsorbent polymer was tested on water: when 500 milligrams of the superabsorbent polymer were mixed with 30 milliliters of water, the resulting hydrogel had a viscosity of over 98000 centipoises.

In some implementations, the absorbent adhesive material is applied to the first and/or second sidewalls 202, 204 to absorb 20 to 50 milliliters of liquid while maintaining a viscosity above 10000 centipoises. In some implementations, the absorbent adhesive material is applied to the first and/or second sidewalls 202, 204 to absorb 25 to 50 milliliters of liquid (e.g., 25, 30, 35, 40, 45, or 50 milliliters of liquid) while maintaining a viscosity above 15000 centipoises. In some implementations, the absorbent adhesive material is applied to the first and/or second sidewalls 202, 204 to absorb 30-40 milliliters of liquid while maintaining a viscosity above 15000 centipoises. In some implementations, the absorbent adhesive material is applied to the first and/or second sidewalls 202, 204 to absorb 25-35 milliliters of liquid while maintaining a viscosity above 50000 centipoises. In some implementations, the absorbent adhesive material is applied to the first and/or second sidewalls 202, 204 to absorb 25-35 milliliters of liquid while maintaining a viscosity above 85000 centipoises.

A person of ordinary skill in the art having the benefit of this disclosure will appreciate that a variety of superabsorbent polymers may be used for the absorbent adhesive material. Moreover, a person of ordinary skill in the art having the benefit of this disclosure will also appreciate that varying amounts of superabsorbent polymer applied to the thermoplastic bag will be effective at maintaining varying viscosity levels for a given amount of liquid. In some implementations, the thermoplastic bag 200 has between 150 and 3000 milligrams of superabsorbent polymer applied to the first and/or second sidewalls 202, 204. In some implementations, the thermoplastic bag 200 has between 300 and 1000 milligrams of superabsorbent polymer applied to the first and/or second sidewalls 202, 204. In some implementations, the thermoplastic bag 200 has between 400 and 900 milligrams of superabsorbent polymer applied to the first and/or second sidewalls 202, 204. In some implementations, the thermoplastic bag 200 has between 500 and 800 milligrams of superabsorbent polymer applied to the first and/or second sidewalls 202, 204.

Figure 3:
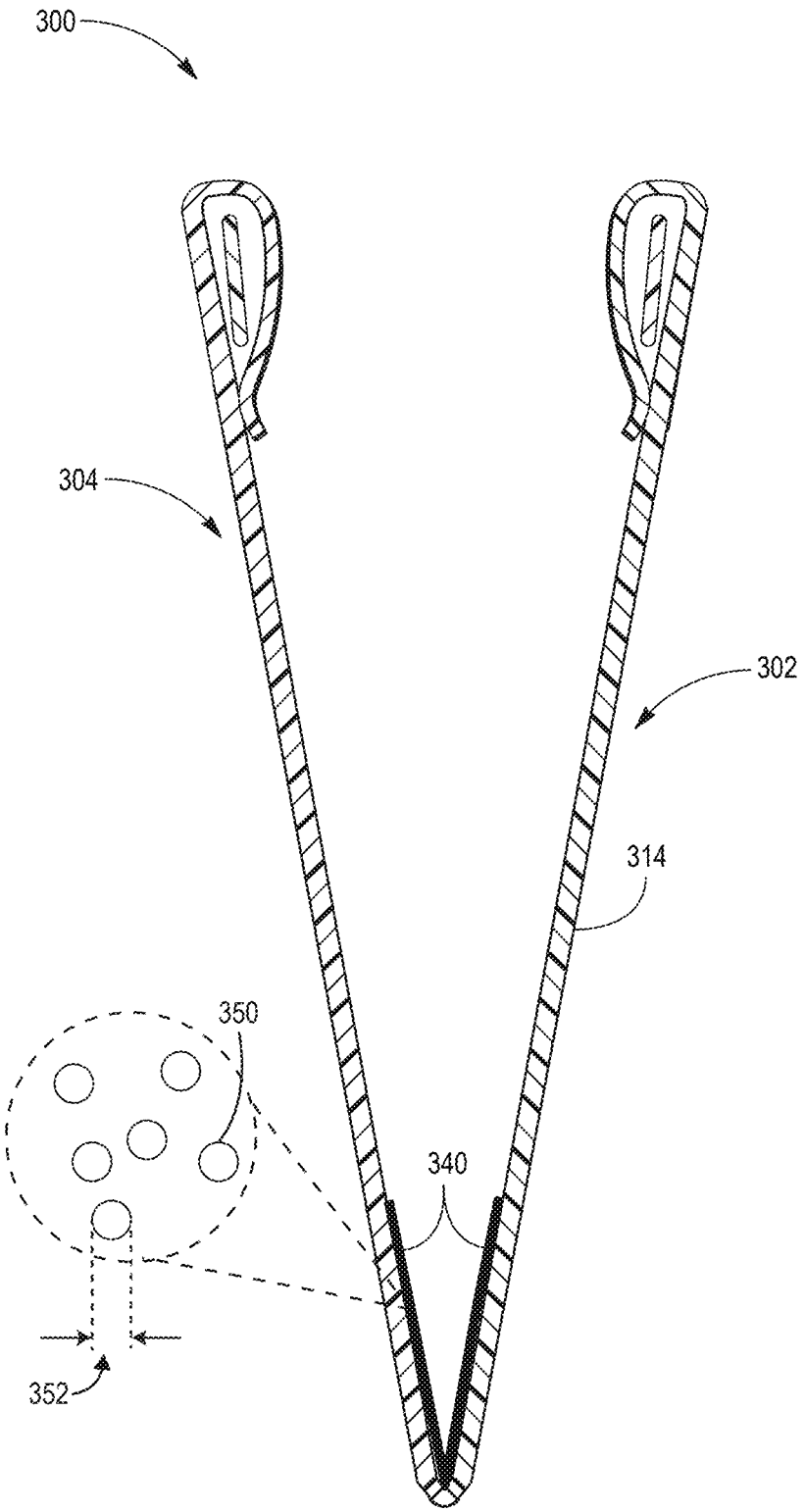
FIG. 3 illustrates a cross-sectional side view of a thermoplastic bag having an absorbent adhesive material in accordance with one or more embodiments.

FIG. 3 is a cross-sectional side view of a thermoplastic bag 300 having an absorbent adhesive material in accordance with one or more embodiments. As shown in FIG. 3, the thermoplastic bag 300 has a first sidewall 302 and a second sidewall 304 that each include a thermoplastic film 314. The thermoplastic film 314 of the first sidewall 302 and the second sidewall 304 can include any of the thermoplastic films described above (e.g., the single layer film 102*a*, the two-layer film 102*b*, the tri-layer film 102*c*, etc.).

Additionally, as shown in FIG. 3, the thermoplastic bag 300 includes an absorbent adhesive material 340 disposed inside the thermoplastic bag 300. More particularly, the thermoplastic bag 300 has the absorbent adhesive material 340 disposed on an internal surface of the first sidewall 302 and on an internal surface of the second sidewall 304. In some embodiments, the thermoplastic bag 300 has the absorbent adhesive material 340 disposed on an internal surface of only one of the sidewalls.

FIG. 3 also shows a schematic view of particles 350 of the absorbent adhesive material 340. In some embodiments, and as further described below in connection with FIG. 8, the absorbent adhesive material 340 is applied to the thermoplastic bag 300 by spraying a liquid slurry that includes the absorbent adhesive material 340 onto a film of the thermoplastic bag 300. In some cases, the liquid slurry includes a nonaqueous carrier that eventually evaporates or is absorbed into the sidewalls 302 and 304, leaving the particles 350 of the absorbent adhesive material 340 (e.g., in a thin layer) on the film of the thermoplastic bag 300.

In some implementations, the particles 350 have a particle size 352 (e.g., a diameter) in a range of between ten and two hundred microns. In some implementations, the particles 350 have a particle size 352 in a range of between ten and ninety microns. In some implementations, the particles 350 have a particle size 352 in a range of between fifteen and fifty microns. In some implementations, the particles 350 have a particle size 352 of about thirty microns. A person of skill in the art having the benefit of this disclosure will appreciate that a particle size 352 smaller than ten microns would yield a reduced absorption capacity, and that a particle size 352 larger than two hundred microns would tend to clog an applicator during the manufacturing process. Moreover, in some implementations, a shape of the particles 350 can influence the particles' tendency to clog an applicator. For example, smooth particles are less likely to clog an applicator than rough particles.

Figure 4:
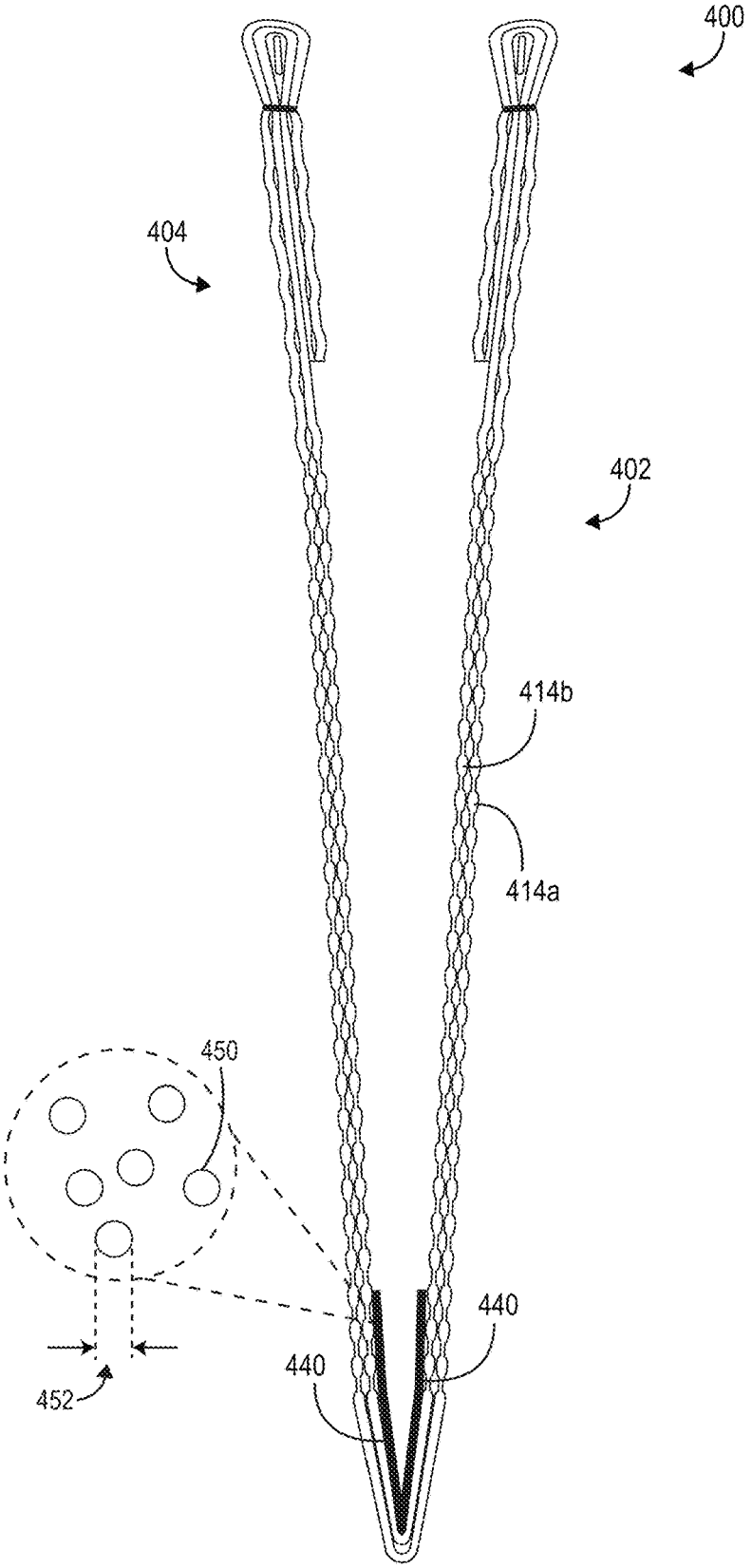
FIG. 4 illustrates a cross-sectional side view of a thermoplastic bag having an absorbent adhesive material in accordance with one or more embodiments.

FIG. 4 is a cross-sectional side view of a thermoplastic bag 400 having an absorbent adhesive material in accordance with one or more embodiments. As shown in FIG. 4, the thermoplastic bag 400 has a first sidewall 402 and a second sidewall 404 that each include a first thermoplastic film 414*a* (e.g., an outer thermoplastic film) and a second thermoplastic film 414*b* (e.g., an inner thermoplastic film). The first thermoplastic film 414*a* of the first sidewall 402 and the second sidewall 404 can include any of the thermoplastic films described above (e.g., the single layer film 102*a*, the two-layer film 102*b*, the tri-layer film 102*c*, etc.). Additionally, the second thermoplastic film 414*b* of the first sidewall 402 and the second sidewall 404 can include any of the thermoplastic films described above (e.g., the single layer film 102*a*, the two-layer film 102*b*, the tri-layer film 102*c*, etc.).

To illustrate, the thermoplastic bag 400 has a bag-in-bag structure. For example, the thermoplastic bag 400 includes a first bag (e.g., a bag with the first thermoplastic film 414*a*) and a second bag (e.g., a bag with the second thermoplastic film 414*b*) positioned therein. More particularly, the first thermoplastic bag comprises first and second opposing sidewalls joined together along a first side edge, an opposite second side edge, and a closed first bottom edge. The second thermoplastic bag is positioned within the first thermoplastic bag. The second thermoplastic bag comprises third and fourth opposing sidewalls joined together along a third side edge, an opposite fourth side edge, and a closed second bottom edge. In one or more implementations, the first thermoplastic bag (e.g., the outer layer) is pigmented with a first color, and the second thermoplastic bag is pigmented with a second color (e.g., the inner layer is pigmented with the second color). As described above, the differing colors of the layers can allow for the creation of visually distinct contact areas when the inner bag and the outer bag are placed into intimate contact.

Moreover, as shown in FIG. 4, the thermoplastic bag 400 includes an absorbent adhesive material 440 disposed inside the thermoplastic bag 400. More particularly, the thermoplastic bag 400 has the absorbent adhesive material 440 disposed on an internal surface of the first sidewall 402 and on an internal surface of the second sidewall 404. More particularly still, the thermoplastic bag 400 has the absorbent adhesive material 440 disposed on an internal surface of the second thermoplastic film 414*b*. In some embodiments, the thermoplastic bag 400 has the absorbent adhesive material 440 disposed on an internal surface of only one of the sidewalls.

FIG. 4 also shows a schematic view of particles 450 of the absorbent adhesive material 440. In some embodiments, and as further described below in connection with FIG. 8, the absorbent adhesive material 440 is applied to the thermoplastic bag 400 by spraying a liquid slurry that includes the absorbent adhesive material 440 onto a film of the thermoplastic bag 400. In some cases, the liquid slurry includes a nonaqueous carrier that eventually evaporates or is absorbed into the sidewalls 402 and 404, leaving the particles 450 of the absorbent adhesive material 440 (e.g., in a thin layer) on the film of the thermoplastic bag 400.

In some implementations, the particles 450 have a particle size 452 (e.g., a diameter) in a range of between ten and two hundred microns. In some implementations, the particles 450 have a particle size 452 in a range of between ten and ninety microns. In some implementations, the particles 450 have a particle size 452 in a range of between fifteen and fifty microns. In some implementations, the particles 450 have a particle size 452 of about thirty microns. A person of skill in the art having the benefit of this disclosure will appreciate that a particle size 452 smaller than ten microns would yield a reduced absorption capacity, and that a particle size 452 larger than two hundred microns would tend to clog an applicator during the manufacturing process. Moreover, in some implementations, a shape of the particles 450 can influence the particles' tendency to clog an applicator. For example, smooth particles are less likely to clog an applicator than rough particles.

The several features of the disclosed thermoplastic bag described herein are applicable both to thermoplastic bags with one thermoplastic layer (e.g., the thermoplastic bag 300) and thermoplastic bags with multiple thermoplastic layers (e.g., the thermoplastic bag 400).

Figure 5:
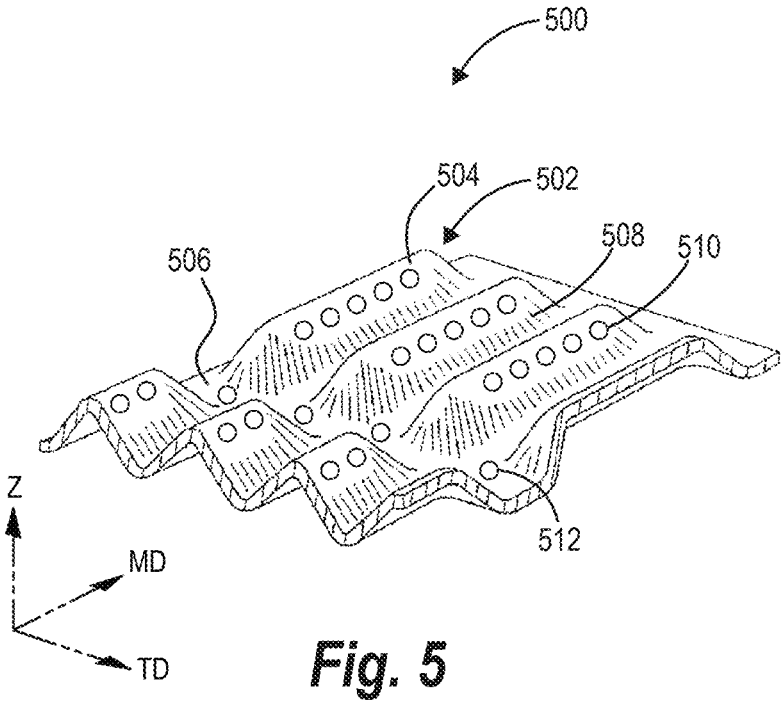
FIG. 5 illustrates a partial cross-sectional perspective view of a thermoplastic bag with particles of an absorbent adhesive material applied to the thermoplastic bag in accordance with one or more embodiments.

FIG. 5 illustrates a partial cross-sectional perspective view of a thermoplastic bag with particles of an absorbent adhesive material applied to the thermoplastic bag according to one or more embodiments. In particular, FIG. 5 shows a portion 500 of a thermoplastic film for a thermoplastic bag (e.g., a portion of a sidewall of the thermoplastic bag). In some embodiments, the thermoplastic bag includes a strainable network comprising a plurality of deformed, raised, rib-like elements 502 caused by a deformation process. As shown in FIG. 5, the strainable network of the thermoplastic bag can include first thicker regions 504, second thicker regions 506, and stretched, thinner transitional regions 508 connecting the first and second thicker regions 504, 506. The first thicker regions 504 and the stretched, thinner transitional regions 508 can form the raised, rib-like elements 502 of the strainable network. Further, the second thicker regions 506 can form web areas of the thermoplastic film. In particular, the second thicker regions 506 can form web areas that are out of plane with the raised, rib-like elements 502 so as to create recesses between adjacent rib-like elements. The raised, rib-like elements 502 can extend from the web areas in a Z-direction perpendicular to the machine direction and the transverse direction of the thermoplastic bag.

Moreover, as shown in FIG. 5, the thermoplastic bag can have particles 510 of an absorbent adhesive material (e.g., a superabsorbent polymer) disposed on the raised, rib-like elements 502. Similarly, the thermoplastic bag can have particles 512 of the absorbent adhesive material disposed on the recesses between the raised, rib-like elements 502. In some embodiments, the thermoplastic bag has particles 512 of the absorbent adhesive material disposed on both the raised, rib-like elements 502 and the recesses between the raised, rib-like elements 502. The absorbent adhesive material can be predominantly located in the recesses between the raised, rib-like elements 502. Moreover, the raised, rib-like elements 502 can increase the surface area of the thermoplastic bag, thereby facilitating the absorbent adhesive material to thin out as it is applied to the thermoplastic bag. In some implementations, the absorbent adhesive material is applied to the thermoplastic bag before the strainable network is formed. Conversely, in some implementations, the absorbent adhesive material is applied to the thermoplastic bag after the strainable network is formed. In some implementations, the absorbent adhesive material is applied to the thermoplastic bag simultaneously with the strainable network being formed.

Figure 6A:
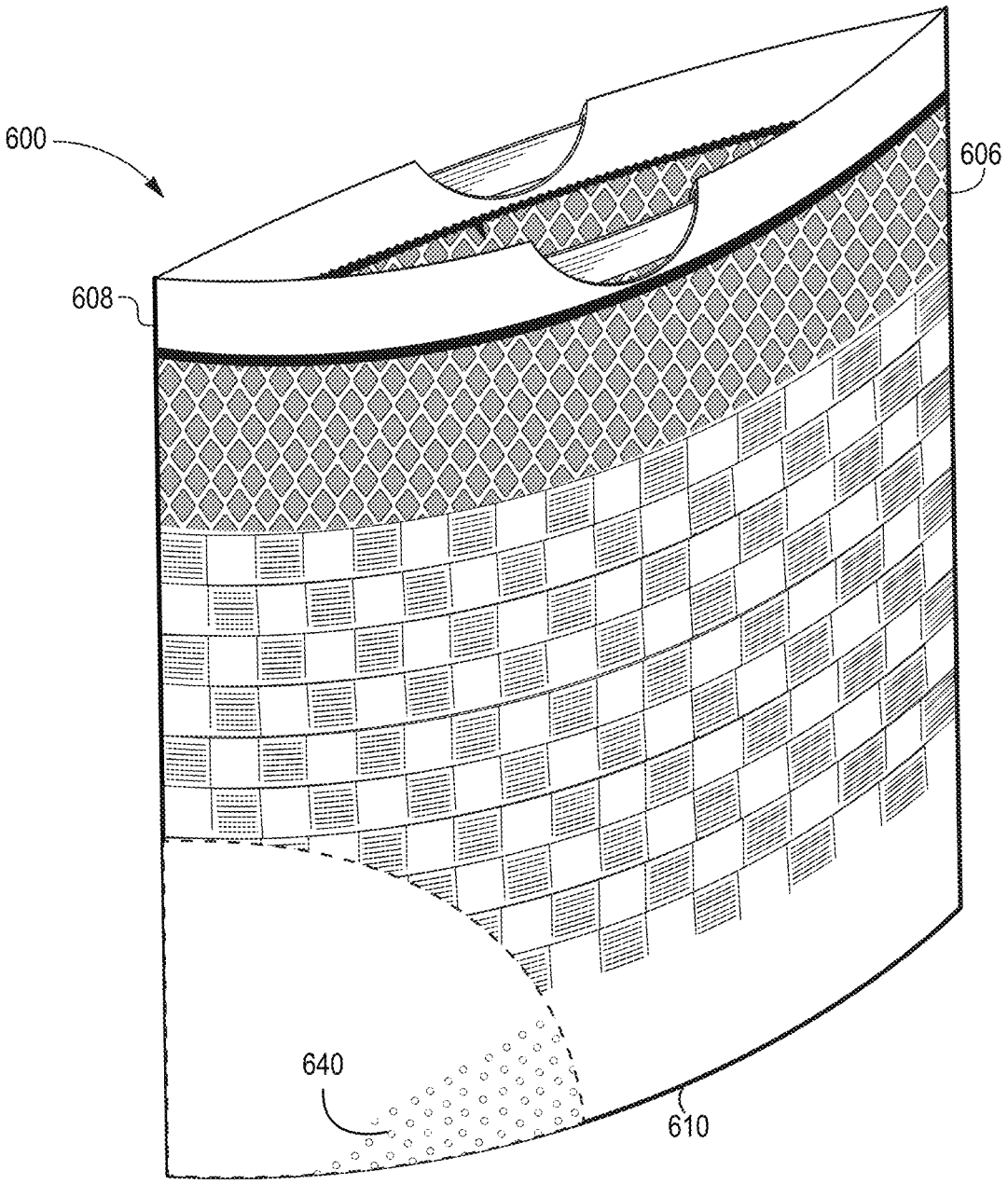
FIGS. 6A-6C illustrate a perspective cutaway view of a thermoplastic bag including an absorbent adhesive material in accordance with one or more embodiments.
Figure 6B:
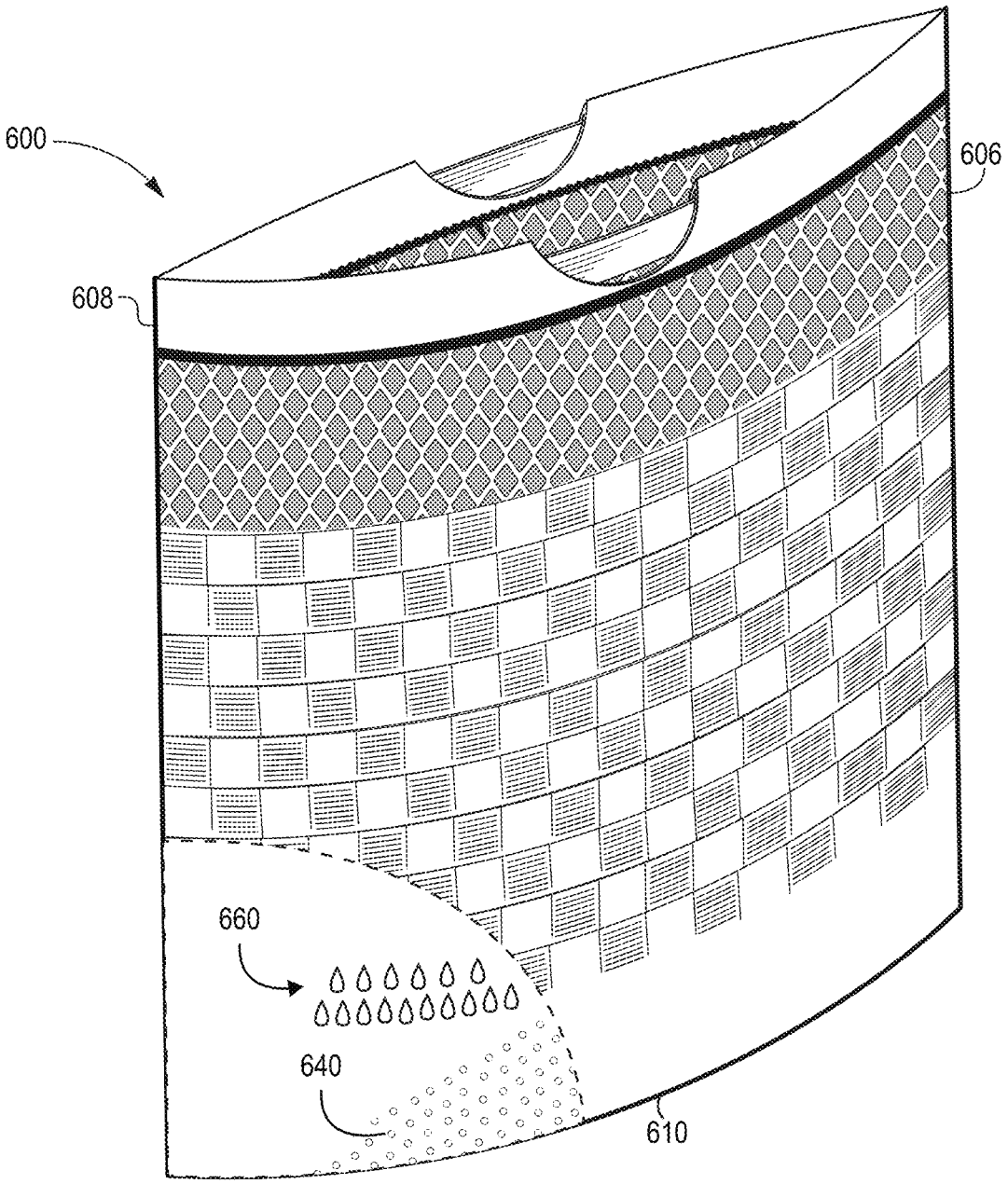
Figure 6C:
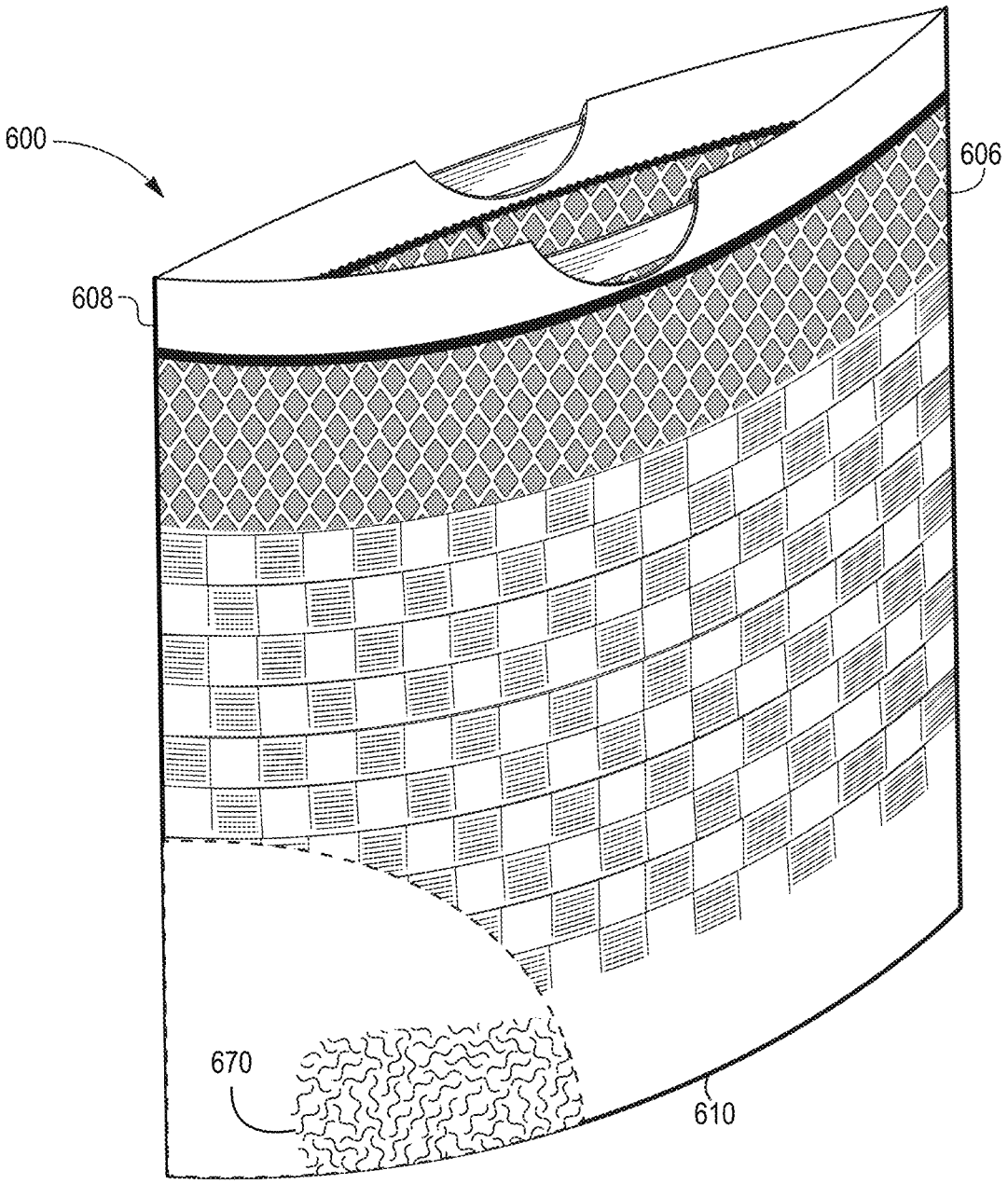

FIGS. 6A-6C illustrate a perspective cutaway view of a thermoplastic bag 600 including an absorbent adhesive material according to one or more embodiments. As shown, the thermoplastic bag 600 includes first and second sidewalls joined together along a first side edge 606, a second opposite side edge 608, and a bottom edge 610 extending between the first and second side edges 606, 608. Moreover, the thermoplastic bag 600 includes an absorbent adhesive material 640 disposed within the thermoplastic bag 600.

In particular, FIG. 6A shows a cutaway view of the absorbent adhesive material 640 disposed within the thermoplastic bag 600. In FIG. 6A, the absorbent adhesive material 640 has not yet come into contact with foreign liquids. In some embodiments, the absorbent adhesive material 640 is disposed in a cluster or region on one or both sidewalls of the thermoplastic bag 600.

Moreover, FIG. 6B shows the cutaway view of the thermoplastic bag 600, though now with a foreign liquid 660 (e.g., water, soft drink, etc.) near the absorbent adhesive material 640. In some cases, the thermoplastic bag 600 is used as a trash bag to collect refuse including, potentially, stray liquids. The absorbent adhesive material 640 can be disposed adjacent or near the bottom edge 610 of the thermoplastic bag 600. When liquids come into contact with the absorbent adhesive material 640, the absorbent adhesive material 640 can absorb the liquids, thereby preventing or limiting further flow of the liquids in and around the thermoplastic bag 600.

To illustrate, FIG. 6C shows the cutaway view of the thermoplastic bag 600, now with the foreign liquid 660 mixed with the absorbent adhesive material 640 to form a hydrogel 670. In some embodiments, the hydrogel 670 has a very high viscosity relative to the liquid 660 before mixture with the absorbent adhesive material 640. For instance, in some implementations, the superabsorbent polymer can mix with 20-50 milliliters of water (or similar liquid) and produce the hydrogel 670 having a viscosity above 15000 centipoises. Moreover, in some implementations, the superabsorbent polymer can mix with 25-35 milliliters of water (or similar liquid) and produce the hydrogel 670 having a viscosity above 15000 centipoises. Furthermore, in some implementations, the superabsorbent polymer can mix with 25-35 milliliters of water (or similar liquid) and produce the hydrogel 670 having a viscosity above 50000 centipoises. In some implementations, the superabsorbent polymer can mix with 25-35 milliliters of water (or similar liquid) and produce the hydrogel 670 having a viscosity above 85000 centipoises.

In addition, the absorbent adhesive material can prevent (or reduce) the incidence of leaks out of the thermoplastic bag 600. For example, by mixing with the liquid 660 to absorb the liquid 660 into the hydrogel 670, the absorbent adhesive material 640 can prevent (or reduce) further flow of the liquid 660. In particular, the absorbent adhesive material 640 can prevent (or limit) leaks of the liquid 660 though holes (e.g., rips, tears, punctures, etc.) in the thermoplastic bag 600. For instance, in some implementations, the absorbent adhesive material is configured to prevent the liquid 660 from egressing out of the thermoplastic bag 600 through a 3/32-inch-diameter hole in the thermoplastic bag 600. To illustrate, a superabsorbent polymer was tested on water: 500 milligrams of the absorbent adhesive material were mixed with 30 milliliters of water, and a 3/32-inch-diameter hole was punctured through a bottom portion of a thermoplastic bag. The water did not leak out of the thermoplastic bag, instead mixing with the superabsorbent polymer into a hydrogel of high viscosity and ceasing flow.

Figure 7:
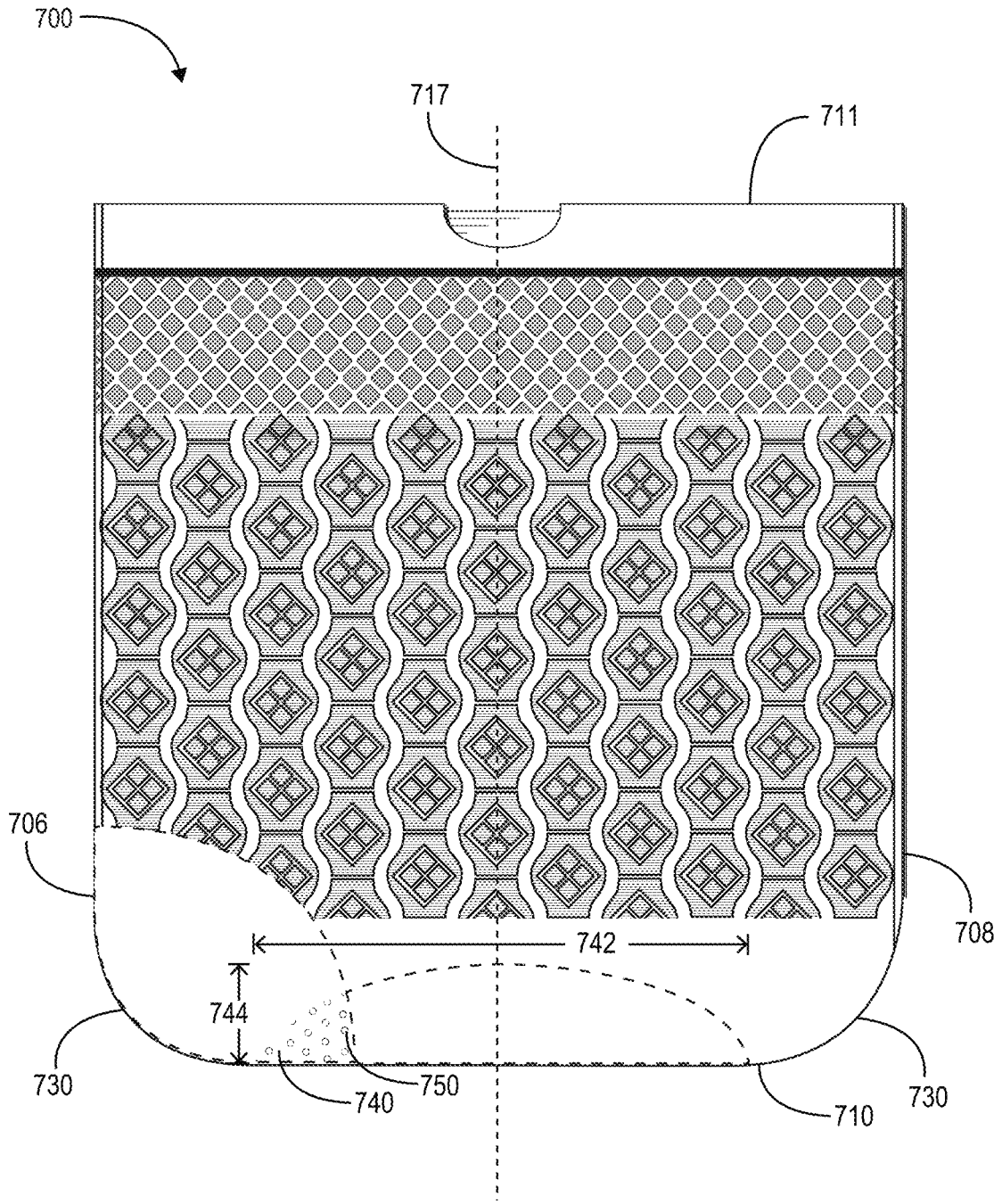
FIG. 7 illustrates a front view of a thermoplastic bag including an absorbent adhesive material in accordance with one or more embodiments.

FIG. 7 is a front view of a thermoplastic bag 700 including an absorbent adhesive material according to one or more embodiments. As shown, the thermoplastic bag 700 includes sidewalls extending between a first side edge 706 and a second opposite side edge 708. Additionally, the thermoplastic bag 700 has a bottom edge 710 and a top edge 711 extending between the first and second side edges 706, 708.

Moreover, FIG. 7 includes a cutaway view at a bottom portion of the thermoplastic bag 700, showing an absorbent adhesive material 740 disposed within the thermoplastic bag 700. As described above in connection with earlier figures, the absorbent adhesive material 740 can be in a thin layer with particles 750. For example, the absorbent adhesive material 740 can be applied to the thermoplastic bag 700 as a slurry or suspension. The absorbent adhesive material 740 then dries to a paste or a thin film on the thermoplastic bag 700. When the absorbent adhesive material 740 combines with liquid (e.g., during use to collect liquid refuse), the absorbent adhesive material 740 can turn into a gel form.

Additionally, as described above, the absorbent adhesive material 740 can be disposed adjacent the bottom edge 710 of the thermoplastic bag 700. For example, the absorbent adhesive material 740 can be disposed as a cluster (e.g., in a region) within the thermoplastic bag 700. In the view of FIG. 7, a dashed line indicates a portion of the region of the absorbent adhesive material 740 that is obscured by the thermoplastic bag 700 (e.g., not in the cutaway view). The region can have a height 744 from the bottom edge 710. For instance, the height 744 can be about four inches. Thus, the absorbent adhesive material 740 can be disposed (e.g., before absorbing foreign liquid) within four inches from the bottom edge 710 of the thermoplastic bag 700.

Moreover, as described above, the absorbent adhesive material 740 can be disposed away from the side edges 706, 708 of the thermoplastic bag 700. For instance, the region of absorbent adhesive material 740 can have a width 742 centered about a centerline 717 of the thermoplastic bag 700. For instance, the width 742 can be about 90% of an overall width of the thermoplastic bag 700. Thus, the absorbent adhesive material 740 can be disposed (e.g., before absorbing foreign liquid) in a center portion of the thermoplastic bag 700 that comprises 90% of the width of the thermoplastic bag 700, centered on the centerline 717 of the thermoplastic bag 700. Applying the absorbent adhesive material 740 to the sidewall(s) of the thermoplastic bag 700 in a central region away from the side edges 706, 708 can increase the incidence of successful side sealing operations. For example, by keeping the absorbent adhesive material 740 away from the side edges 706, 708, the manufacturing process can reduce side seal failures when applying a heat seal to the side edges 706, 708.

Additionally, in some embodiments, the thermoplastic bag 700 includes rounded corners. For example, the sidewalls of the thermoplastic bag 700 can have a rounded corner 730 between the first side edge 706 and the bottom edge 710, and another rounded corner 730 between the second side edge 708 and the bottom edge 710. The rounded corners 730 can present several advantages. For example, the rounded corners 730 can help reduce thermoplastic material used to manufacture the thermoplastic bag 700. Additionally, the rounded corners 730 can help direct liquids within the thermoplastic bag 700 toward the absorbent adhesive material 740 to be absorbed by the absorbent adhesive material 740.

Figure 8:
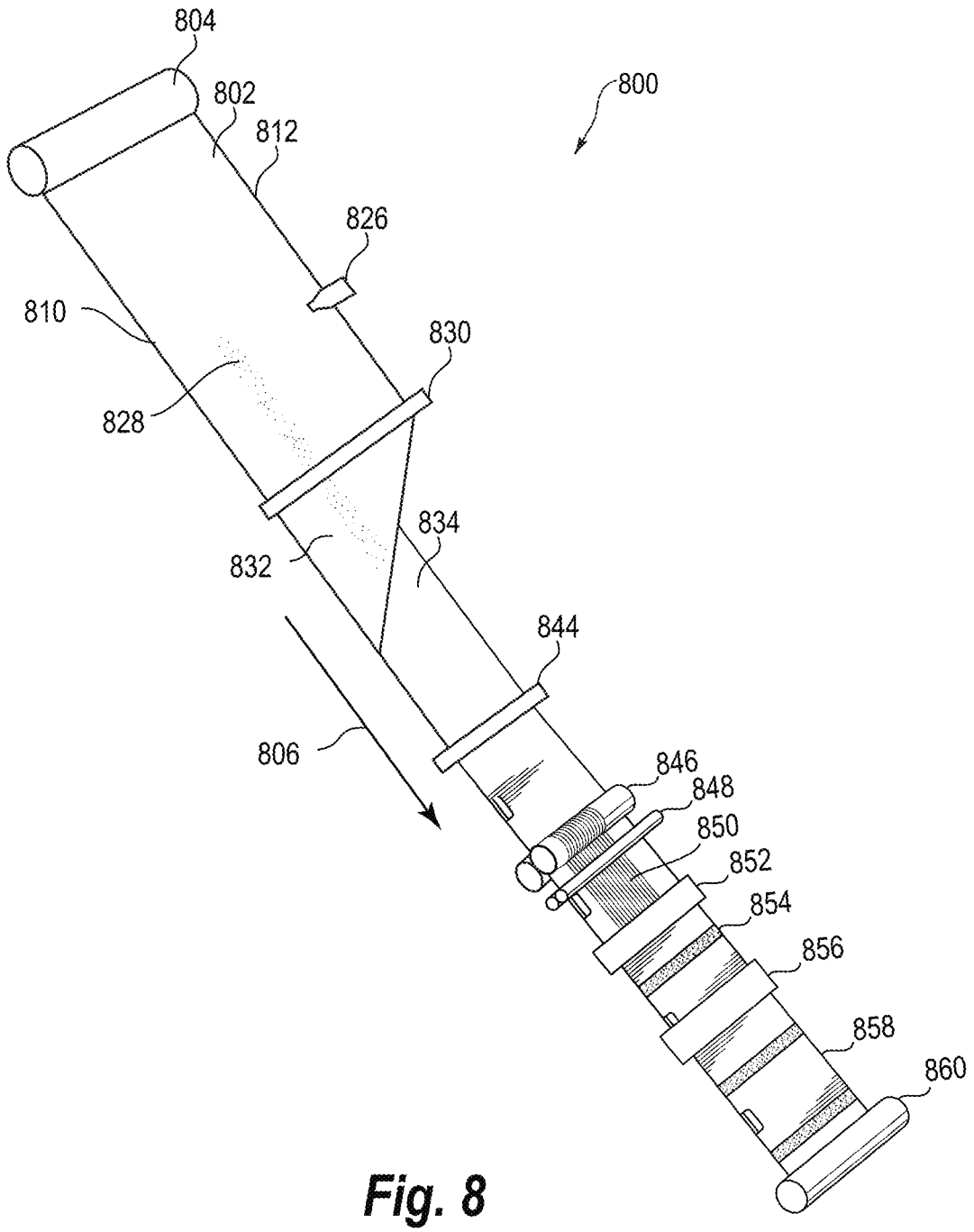
FIG. 8 illustrates a schematic of an implementation for a high-speed automated manufacturing process of thermoplastic bags in accordance with one or more embodiments.

One or more implementations of the present invention can also include methods of forming thermoplastic bags. FIG. 8 and the accompanying description describes such methods. Of course, as a preliminary matter, one of ordinary skill in the art will recognize that the methods explained in detail herein can be modified. For example, various acts of the methods described can be omitted, repeated, and/or expanded. Furthermore, additional acts can be included, and the order of the various acts of the methods described can be altered as desired.

FIG. 8 is a schematic of an implementation for a high-speed automated manufacturing process 800 of thermoplastic bags. In the illustrated implementation, the process 800 may begin by unwinding a web 802 of thermoplastic sheet material from a roll 804 and advancing the web along a machine direction 806. The unwound web 802 may have a rectangular profile including a width that is perpendicular to the machine direction 806 as measured between a first edge 810 and an opposite second edge 812. In other manufacturing environments, the process may involve extruding the web 802 using a thermoplastic production process.

After unwinding the web 802, the process 800 can involve dispensing a substance 828 containing an absorbent adhesive material (e.g., a superabsorbent polymer) using a dispenser 826. In one or more embodiments, the dispenser 826 applies the substance 828 as a series of micro-droplets. In some implementations, the dispenser 826 applies the substance 828 as a plug shot or a slurry droplet that is then spread over a portion of the web 802 by a nip roll. In some implementations, however, the dispenser 826 sprays the respective substance, atomizing the absorbent adhesive material for application. Thus, the dispenser 826 can increase the surface area covered by the substance 828. The substance 828 can include an aqueous or a nonaqueous carrier. Further, where a nonaqueous carrier is used, by spraying, the dispenser 826 can apply a thin layer of the absorbent adhesive material for quick drying of the nonaqueous carrier, thereby increasing the chance that the absorbent adhesive material will be dry by the time the resulting thermoplastic bag is retrieved for use. In some implementations, the dispenser 826 sprays the substance 828 intermittently to avoid applying the substance 828 where the side seals will be formed (e.g., for better adhesion of the side seals). In one or more embodiments, the substance 828 is additionally, or alternatively, applied using a roller or a slot cast. It should be noted that the position of the substance 828 on the web 802 is shown for illustration purposes only, and is not necessarily drawn to scale. Indeed, the dispenser 826 can be configured to position the substance 828 in a variety of locations on the web 802.

In some implementations, the process 800 utilizes alternative methods for applying the substance 828 containing the absorbent adhesive material. For example, the process 800 can apply the substance 828 via prills, coacervation, emulsion, dripping, gelation, and/or coating.

In one or more embodiments, the substance 828 includes a liquid application (e.g., a nonaqueous carrier), a powder application, or any other application discussed above. In one or more embodiments, the substance 828 is applied with a binding agent (e.g., methyl cellulose) to improve adhesion of the substance without making the bag sticky when a consumer tries to open the bag. To illustrate, the binding agent can include a water-soluble resin/binder, such as hydroxypropyl methylcellulose (HPMC), polyethylene glycol, polyethylene oxide, polyvinylpyrrolidone, alginate, polyvinyl alcohol, celluloses (e.g., hydroxypropyl cellulose, carboxymethyl cellulose, hydroxypropyl methylcellulose) or pullulan. In some embodiments, the binding agent includes an oil-soluble resin/binder. In some instances, the binding agent includes water-insoluble resins/binders (e.g., nitrocellulose, CAB, acrylates, urethanes, acrylic resins, silicone resins, etc.). Such a binding agent can be used, for instance, in combination with encapsulants triggered to release the superabsorbent polymer in response to contact with water or other liquids. In some implementations, the binding agent includes one or more hot melts or acrylates.

In some embodiments, the substance 828 is applied with an ultraviolet (UV) indicator to provide visual evidence of the spray pattern (e.g., under a black light) or to help identify a clogged nozzle during manufacturing. In some implementations, the substance 828 is applied with a color indicator so that a consumer can visually identify a location of the absorbent adhesive material. For example, the color indicator can include an oil soluble dye encapsulated within encapsulants of the superabsorbent polymer, which allows a consumer to see where activation is occurring. In some embodiments, the color indicator includes a water-soluble dye that is mixed into the aqueous phase of the absorbent adhesive material to show the consumer where the absorbent adhesive material has been applied. In some embodiments, the color indicator includes titanium dioxide.

As mentioned above, the process 800 can be modified so that the act of applying the substance 828 containing the absorbent adhesive material can occur earlier or later than what is shown in FIG. 8. For example, in one or more embodiments, the substance 828 can be coextruded with the web 802 using the thermoplastic production process.

Subsequently, the process 800 can include a folding process 830 that involves folding the web 802 about its width and in-line with the machine direction 806 to provide adjacent first and second folded halves 832, 834. The folding of the web 802 may cause the second edge 812 to move adjacent to the first edge 810 such that the two edges correspond to the opened top edge of the finished bag. The mid-width portion of the web 802 may correspond to the reinforced bottom edge portion of the finished bag which may move in parallel with the machine direction 806. Additionally, the folded halves 832, 834 of the web 802 correspond to the first and second sidewalls of the finished bag. As suggested above, applying the substance 828 containing the absorbent adhesive material can occur after the folding process 830. For example, in some implementations, the process 800 utilizes one or more dispensers that insert the substance 828 into an open portion of the folded bag.

Additional processing steps may be applied to produce the finished bag. In particular, the process 800 can include a draw tape insertion process 844 that involves inserting a draw tape into the first edge 810 and the second edge 812 of the web 802.

Optionally, to bond (and optionally stretch) the halves of the web 802, the processing equipment may include a pair of intermeshing rollers 846. The folded halves 832, 834 may be advanced along the machine direction 806 between the intermeshing rollers 846, which may be set into rotation in opposite rotational directions to impart a resulting bonding pattern 850. To facilitate patterning of the folded halves 832, 834, the intermeshing rollers 846 may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one or more implementations, the pressure may be about 80 PSI (5.44 atm).

In the illustrated implementation, the intermeshing rollers 846 may be arranged so that they are co-extensive with or wider than the width of the folded halves 832, 834. In one or more implementations, the bonding pattern 850 created by intermeshing rollers 846 may extend from proximate the folded edge to the adjacent edges 810, 812. To avoid imparting the bonding pattern 850 onto the portion of the folded halves 832, 834 that includes the draw tape, the corresponding ends of the intermeshing rollers 846 may be smooth and without ridges and grooves. Thus, the adjacent edges 810, 812 and the corresponding portion of the folded halves 832, 834 proximate those edges that pass between the smooth ends of the intermeshing rollers 846 may not be imparted with the bonding pattern 850.

The processing equipment may include pinch rollers 848 to accommodate the width of the folded halves 832, 834. To produce the finished bag, the processing equipment may further process the folded halves 832, 834. For example, to form the parallel side edges of the finished bag, the folded halves 832, 834 may proceed through a sealing operation 852 in which heat seals 854 may be formed between the folded edge and the adjacent edges 810, 812. The heat seals may fuse together the adjacent folded halves 832, 834. The heat seals 854 may be spaced apart along the folded halves 832, 834 and in conjunction with the folded outer edge may define individual bags. The heat seals 854 may be made with a heating device, such as a heated knife or sealing bars. A perforating operation 856 may perforate the heat seals 854 with a perforating device, such as a perforating knife so that individual bags 858 may be separated from the web 802. In one or more implementations, the folded halves 832, 834 may be folded one or more times before the folded halves 832, 834 may be directed through the perforating operation. The folded halves 832, 834 embodying the individual bags 858 may be wound into a roll 860 for packaging and distribution. For example, the roll 860 may be placed in a box or a bag for sale to a customer.

In one or more implementations of the process 800, a cutting operation may replace the perforating operation 856. For example, the web 802 may be directed through a cutting operation which cuts the folded halves 832, 834 at location into individual bags 858 prior to winding onto a roll 860 for packaging and distribution. For example, the roll 860 may be placed in a box or bag for sale to a customer. The individual bags 858 may be interleaved prior to winding into the roll 860. In one or more implementations, the folded halves 832, 834 may be folded one or more times before the folded web is cut into individual bags. In one or more implementations, the individual bags 858 may be positioned in a box or bag, and not onto the roll 860.

While there have been prior efforts to add superabsorbent polymers to thermoplastic bags, these efforts have not yielded success in terms of producing viable thermoplastic bags that both stop leaks and are manufacturable. In particular, prior attempts to add superabsorbent polymers to thermoplastic bags have failed because the superabsorbent polymers either did not stop leaks (e.g., because the superabsorbent polymers did not have high enough viscosities when mixed with liquids in the bag) or the bags were not able to be produced at scale (e.g., because the superabsorbent polymers caused problems with the manufacturing process, such as gumming up the bags) or both. However, as the test results shown in FIG. 9 demonstrate, embodiments of the present disclosure overcome these drawbacks by yielding thermoplastic bags with superabsorbent polymers that stop leaks and yet are manufacturable.

Figure 9:
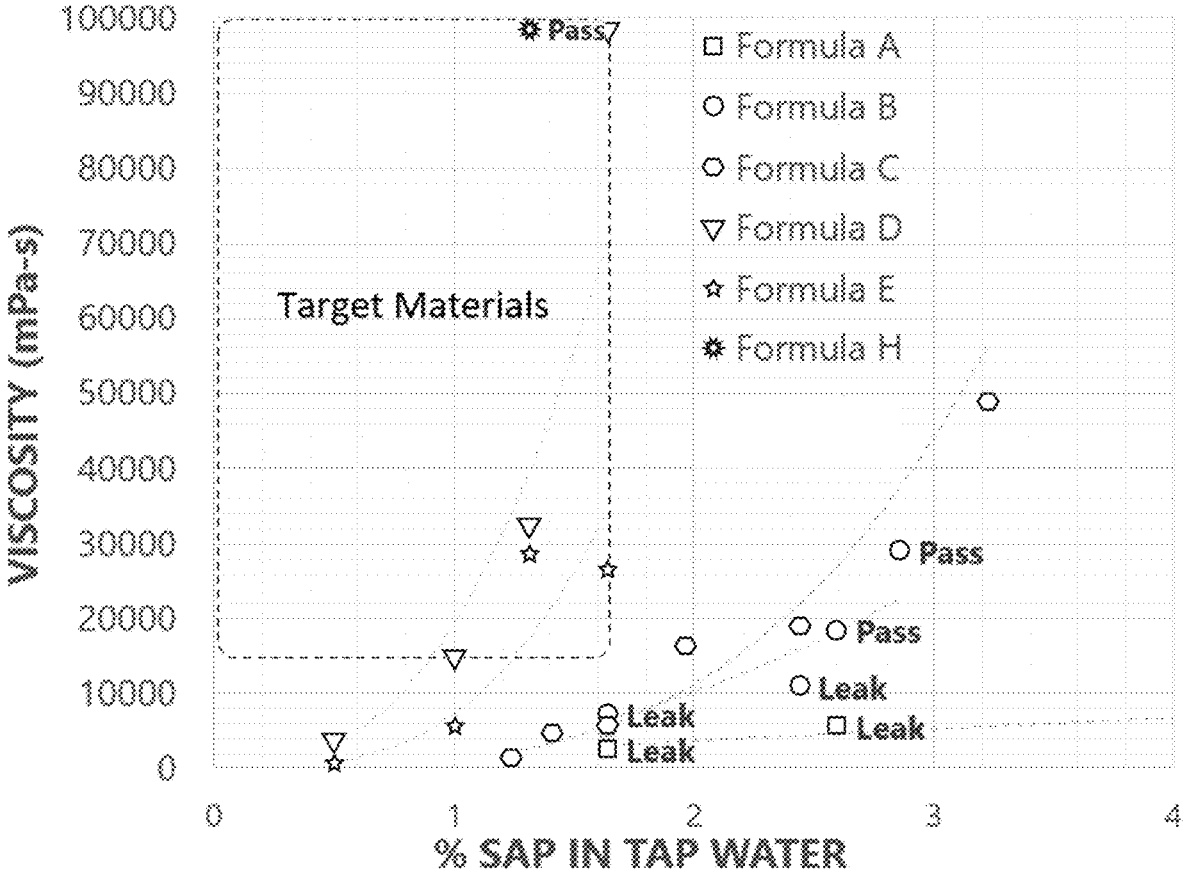
FIG. 9 illustrates experimental results of leak tests performed on a variety of superabsorbent polymer formulas in accordance with one or more embodiments.

Various formulas of superabsorbent polymers were tested in test tubes (e.g., as absorbent adhesive materials mixed with tap water). In particular, FIG. 9 shows empirical results for several different formulas of superabsorbent polymers that were tested in test tubes (e.g., various percentages by weight of superabsorbent polymer per unit tap water). In each test, the formula of superabsorbent polymer was mixed with twenty milliliters of tap water to determine viscosities of resulting superabsorbent polymer-water mixtures. As shown in FIG. 9, in general, an increase in quantity of superabsorbent polymer (e.g., an increase in percentage of superabsorbent polymer per unit tap water) results in an increase in viscosity for the mixture.

The mixtures of superabsorbent polymer with water were tested in thermoplastic bags to determine which mixtures leak out of a small hole (e.g., a 3/32-inch-diameter hole) in the thermoplastic bag. In general, mixtures with resultant viscosities less than 15,000 centipoises tended to leak out of the hole in the thermoplastic bag. Conversely, mixtures with resultant viscosities greater than 15,000 centipoises tended not to leak out of the hole in the thermoplastic bag, thereby passing the leak test.

Moreover, although a greater percentage of superabsorbent polymer per unit water tends to increase viscosity of the resulting mixture (and thus tends to increase the likelihood of passing a leak test), it also tends to impede manufacturing of thermoplastic bags having the superabsorbent polymer added to the thermoplastic bags in an absorbent adhesive material. Thus, to produce a viable thermoplastic bag having absorbent adhesive material, the amount of superabsorbent polymer should generally be limited.

As shown in FIG. 9, some formulas of superabsorbent polymer have been identified that have sufficient absorbency to pass a leak test while at low enough quantities to allow manufacture of thermoplastic bags with the superabsorbent polymer. For instance, in some embodiments, desirable formulas of superabsorbent polymer for application in a thermoplastic bag have resulting viscosity greater than 15,000 centipoises when the formula of superabsorbent polymer is mixed with tap water in a percentage range between 0.1 percent and 1.7 percent. This range of superabsorbent polymer quantity can be manufactured in thermoplastic bags at scale. Also, resultant viscosities greater than 15,000 centipoises are sufficiently viscous to pass a leak test. As shown in FIG. 9, a number of such formulas of superabsorbent polymer qualified in these ranges during the experiments. In particular, at least three different formulas of superabsorbent polymer were identified that produced sufficient viscosity in mixtures with water to pass the leak test at quantities low enough for manufacturability in thermoplastic bags.

The use in the foregoing description and in the appended claims of the terms "first," "second," "third," etc., is not necessarily to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget, and not necessarily to connote that the second widget has two sides.

In the foregoing description, the invention has been described with reference to specific exemplary embodiments thereof. Various embodiments and aspects of the invention(s) are described with reference to details discussed herein, and the accompanying drawings illustrate the various embodiments. The description above and drawings are illustrative of the invention and are not to be construed as limiting the invention. Numerous specific details are described to provide a thorough understanding of various embodiments of the present invention.

The present invention may be embodied in other specific forms without departing from its spirit or essential characteristics. The described embodiments are to be considered in all respects only as illustrative and not restrictive. For example, the methods described herein may be performed with fewer or more steps/acts or the steps/acts may be performed in differing orders. Additionally, the steps/acts described herein may be repeated or performed in parallel with one another or in parallel with different instances of the same or similar steps/acts. The scope of the invention is, therefore, indicated by the appended claims rather than by the foregoing description. All changes that come within the meaning and range of equivalency of the claims are to be embraced within their scope.

What is claimed is:

1. A thermoplastic bag comprising:

a first sidewall and a second sidewall joined together along a first side edge, a second side edge, and a bottom edge;

an opening opposite the bottom edge; and an absorbent adhesive material disposed on at least one of the first sidewall and the second sidewall, the absorbent adhesive material configured to absorb at least 20 milliliters of liquid while maintaining a viscosity above 15,000 centipoises.

2. The thermoplastic bag of claim 1, wherein the absorbent adhesive material comprises a superabsorbent polymer that has, before absorbing the liquid, a particle size of 10 to 200 microns.

3. The thermoplastic bag of claim 1, wherein the absorbent adhesive material comprises a superabsorbent polymer that has, before absorbing the liquid, a particle size of 15 to 50 microns.

4. The thermoplastic bag of claim 1, wherein the absorbent adhesive material is disposed, before absorbing the liquid, within four inches from the bottom edge of the thermoplastic bag.

5. The thermoplastic bag of claim 1, wherein the absorbent adhesive material is disposed, before absorbing the liquid, in a center portion of the thermoplastic bag, the center portion comprising 90% of a width of the thermoplastic bag centered on a centerline of the thermoplastic bag.

6. The thermoplastic bag of claim 1, wherein the first sidewall and the second sidewall each comprise rounded corners between the first side edge and the bottom edge, and between the second side edge and the bottom edge.

7. The thermoplastic bag of claim 1, wherein the absorbent adhesive material is configured to, upon absorption of 25-50 milliliters of liquid, prevent the 25-50 milliliters of liquid from egressing out of the thermoplastic bag through a 3/32-inch-diameter hole in the thermoplastic bag.

8. The thermoplastic bag of claim 1, wherein the absorbent adhesive material is configured to absorb 25-50 milliliters of liquid while maintaining a viscosity above 15,000 centipoises.

9. The thermoplastic bag of claim 1, wherein the absorbent adhesive material is configured to absorb 25-50 milliliters of liquid while maintaining a viscosity above 50,000 centipoises.

10. The thermoplastic bag of claim 1, wherein the absorbent adhesive material is configured to absorb 25-50 milliliters of liquid while maintaining a viscosity above 85.000 centipoises.

11. A thermoplastic bag comprising:

a first sidewall and a second sidewall joined together along a first side edge, a second side edge, and a first bottom edge;

a third sidewall and a fourth sidewall joined together along a third side edge, a fourth side edge, and a second bottom edge, the third and fourth sidewalls disposed within an interior space at least partially enclosed by the first and second sidewalls;

an opening opposite both of the first bottom edge and the second bottom edge; and an absorbent adhesive material disposed on at least one of the third sidewall and the fourth sidewall, the absorbent adhesive material configured to absorb at least 20 milliliters of liquid while maintaining a viscosity above 15,000 centipoises.

12. The thermoplastic bag of claim 11, wherein the absorbent adhesive material comprises a superabsorbent polymer that has, before absorbing the liquid, a particle size of 10 to 200 microns.

13. The thermoplastic bag of claim 11, wherein the absorbent adhesive material comprises a superabsorbent polymer that has, before absorbing the liquid, a particle size of 15 to 50 microns.

14. The thermoplastic bag of claim 11, wherein the absorbent adhesive material is disposed, before absorbing the liquid, within four inches from the second bottom edge of the thermoplastic bag.

15. The thermoplastic bag of claim 11, wherein the absorbent adhesive material is disposed, before absorbing the liquid, in a center portion of the thermoplastic bag, the center portion comprising 90% of a width of the thermoplastic bag centered on a centerline of the thermoplastic bag.

16. The thermoplastic bag of claim 11, wherein the first sidewall and the second sidewall each comprise rounded corners between the first side edge and the first bottom edge, and between the second side edge and the first bottom edge, and wherein the third sidewall and the fourth sidewall each comprise rounded corners between the third side edge and the second bottom edge, and between the fourth side edge and the second bottom edge.

17. The thermoplastic bag of claim 11, wherein the absorbent adhesive material is configured to, upon absorption of 25-50 milliliters of liquid, prevent the 25-50 milliliters of liquid from egressing out of the thermoplastic bag through a hole in the thermoplastic bag due to the viscosity.

18. The thermoplastic bag of claim 11, wherein the absorbent adhesive material is configured to absorb 25-50 milliliters of liquid while maintaining a viscosity above 15,000 centipoises.

19. The thermoplastic bag of claim 11, wherein the absorbent adhesive material is configured to absorb 25-50 milliliters of liquid while maintaining a viscosity above 50,000 centipoises.

20. The thermoplastic bag of claim 11, wherein the absorbent adhesive material is disposed over a plurality of deformed, raised, rib-like elements formed in the third sidewall.

* * * * *